US006307134B1

(12) United States Patent
Lombardi

(10) Patent No.: US 6,307,134 B1
(45) Date of Patent: Oct. 23, 2001

(54) CASE CONFIGURED AS A SUBSTITUTE DRUM

(75) Inventor: Donald G. Lombardi, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 09/748,769

(22) Filed: Dec. 27, 2000

(51) Int. Cl.[7] ..... G10D 13/02
(52) U.S. Cl. ..... 84/411 R; 84/421; 84/327
(58) Field of Search ..... 84/411 R, 421, 84/422.1, 422.2, 327, 411 P, 412

(56) References Cited

U.S. PATENT DOCUMENTS 2,563,346 * 8/1951 Livingston ..... 84/412
2,850,156 * 9/1958 Shane ..... 84/411 R
3,026,759 * 3/1962 Kleiner et al. ..... 84/411
4,060,019 * 11/1977 Cordes ..... 84/411 R
4,841,830 * 6/1989 Yamashita ..... 84/1.14
5,408,913 * 4/1995 Hoshino ..... 84/421
5,419,430 * 5/1995 Wilson et al. ..... 206/216
5,998,717 * 12/1999 Chen ..... 84/421
6,057,499 * 5/2000 Basmadjian ..... 84/411 R

FOREIGN PATENT DOCUMENTS

604891 * 3/1960 (IT) ..... 84/411

* cited by examiner

*Primary Examiner*—Robert E. Nappi
*Assistant Examiner*—Kim Lockett
(74) *Attorney, Agent, or Firm*—William W. Haefliger

(57) ABSTRACT

A substitute drum, the combination comprising a hollow case to contain equipment for transportation, and removal from the case, the case having a side wall that is relatively stiff, and a support to support the case with a side wall extending in a selected position, during striking motion transmitted to the side wall by a drum beater.

27 Claims, 5 Drawing Sheets

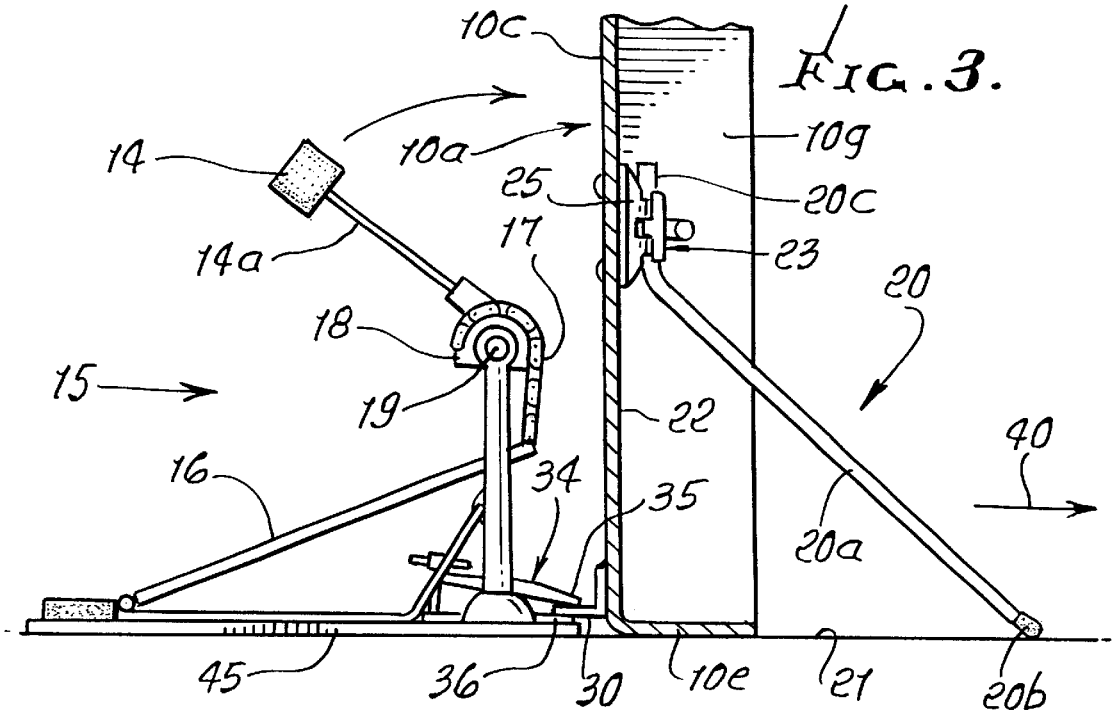
FIG. 3.
FIG. 4.
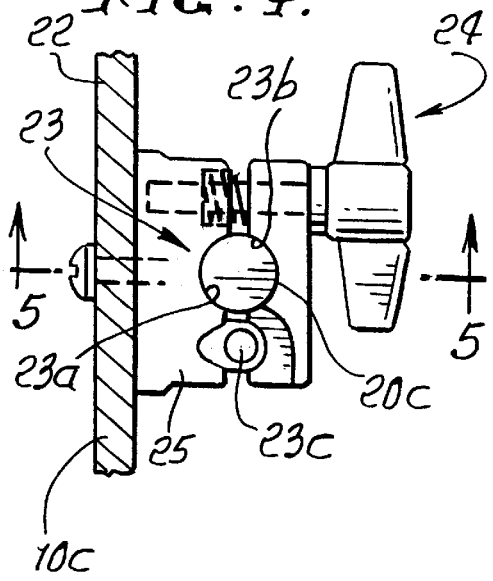
FIG. 5.
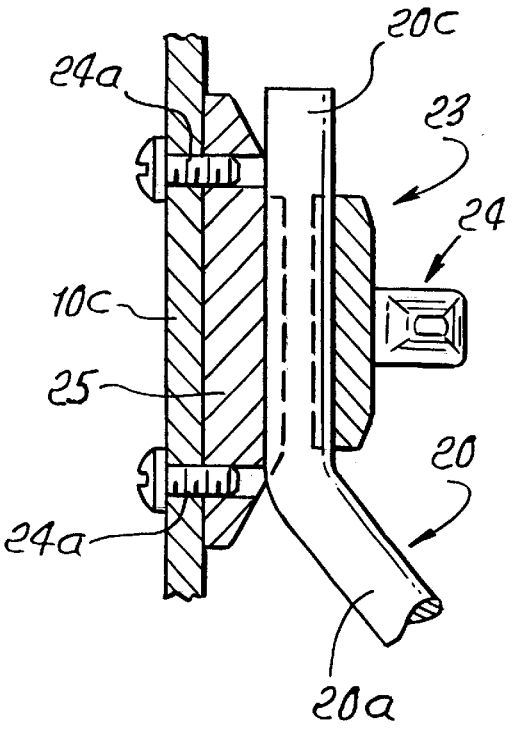

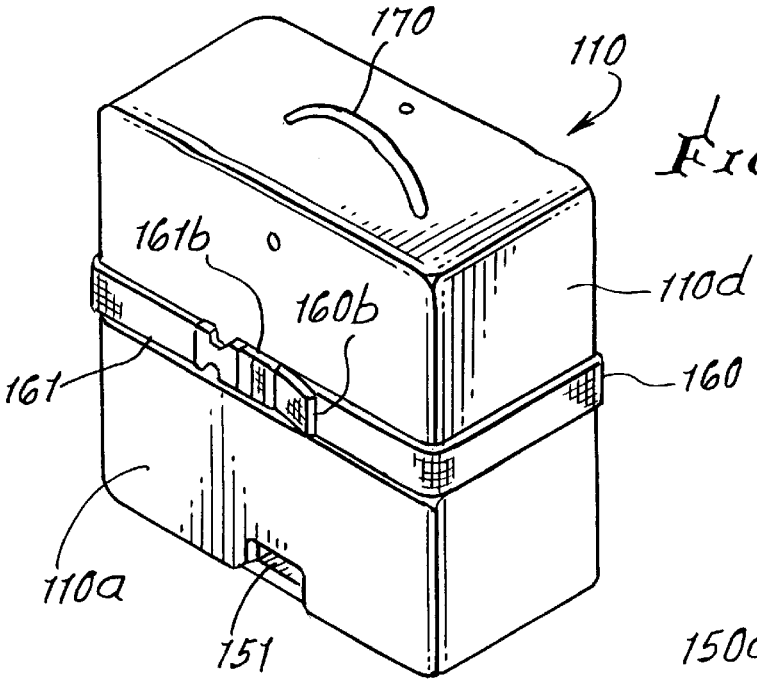
FIG. 8.
FIG. 11.
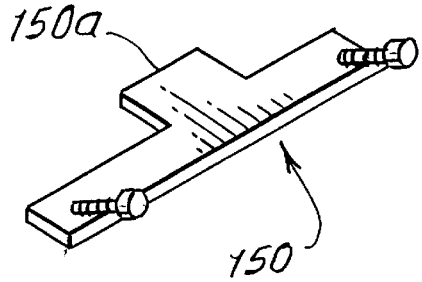
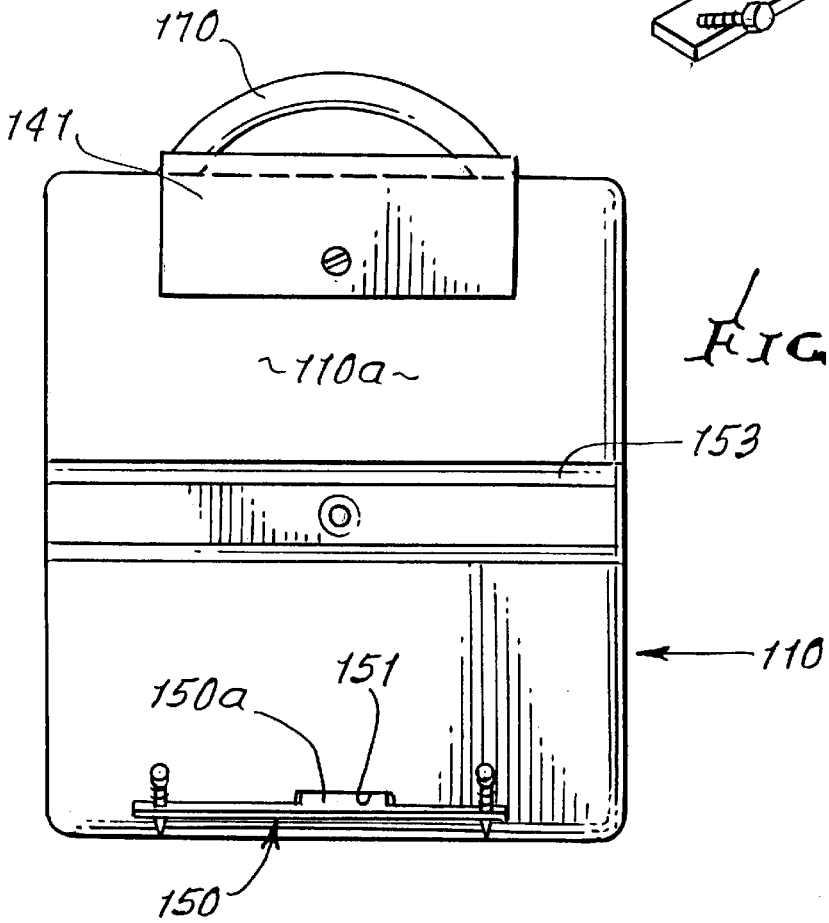
FIG. 10.

CASE CONFIGURED AS A SUBSTITUTE DRUM

BACKGROUND OF THE INVENTION

This invention relates generally to drum beating equipment, and more particularly to equipment employing a substitute drum in the form of a carrying case.

There is need for equipment allowing a drummer to practice drumming using a foot operated pedal, but where a large standard drum is not used. There is also need for such equipment that can be set up quickly and easily, for practice drumming.

SUMMARY OF THE INVENTION

It is a major object of the invention to provide equipment meeting the above need. Basically, the invention allows the drummer to set up his foot operated pedal unit in such relation to a hollow case, as for example the pedal unit carrying case, that the beater of the pedal unit can be operated to beat against a wall of the case, the case being supported to facilitate such operation.

As will be seen the equipment includes:

a) a hollow case to contain equipment for transportation, and removal from the case, b) the case having a side wall that is relatively stiff, c) and a support carried by the case to support the case with said side wall extending in a selected position, during striking motion transmitted to the side wall by a drum beater.

In this regard, the side wall of the case to be struck by the beater typically consists of plastic material; and the case itself including that side wall may consist of molded plastic material.

The case support may be provide to extend from the interior of the case to the exterior, as for example after the case is opened; and the support is advantageously configured to support the side wall at the case interior, and so as to extend to the case exterior. That support may be moved from supporting position, so as to be entirely received in the case interior, for transportation along with the equipment such as a pedal unit placed in the case.

A further object is to provide the support in the form of a leg that has an end portion connected to said side wall, at the case interior, and a foot at the case exterior, when the leg is in case supporting position. The leg may then have an alternate position, as refereed to, wherein the leg is stored, at the interior of the case, for transportation.

Yet another object is to provide a ledge on the case and projecting for engagement by a clamp associated with a drum beater unit extending proximate the case. That ledge may consist of a foot attached to the case to project near the lower extent of the side wall, so as to be clamped by the beater unit clamp.

The case may also be provided with a suitable carry handle, above the level of the projecting foot.

Further objects include the provision of a support in the form of a case section, which may have receptacle configuration; the provision for attachment of the section to the case in an adjusted position in which the case section projects both inside and outside the case; the provision of an anchor plate attached to the case, to anchor to the base of a drum beating pedal unit; the provision of a beater striking plate attached to the case, and the provision of a retention strap extending about the assembled case and case section.

A yet further object includes the provision of the following combination:

a) a drum beater unit having a base, a drum beater, and a pedal operated actuator to rotate the beater, b) and a stiff upright plate facing said unit and carrying a drum beater striking surface.

These and other objects and advantages of the invention, as well as the details of an illustrative embodiment, will be more fully understood from the following specification and drawings, in which:

DRAWING DESCRIPTION

FIG. 3 is an elevation showing the case and pedal unit positioned for active drumming against the case side wall;

FIG. 4 is an enlarged section showing mounting of the case support, facilitating quick adjustment;

FIG. 5 is a further enlarged section taken on lines 5—5 of FIG. 4;

FIG. 8 is a view like FIG. 7, but showing opposite side of the cover;

FIG. 10 is an elevation taken on lines 10—10 of FIG. 9; and

FIG. 11 is a perspective view of an anchor plate attachable to the cover.

DETAILED DESCRIPTION OF PREFERRED EMBODIMENT

Figure 1:
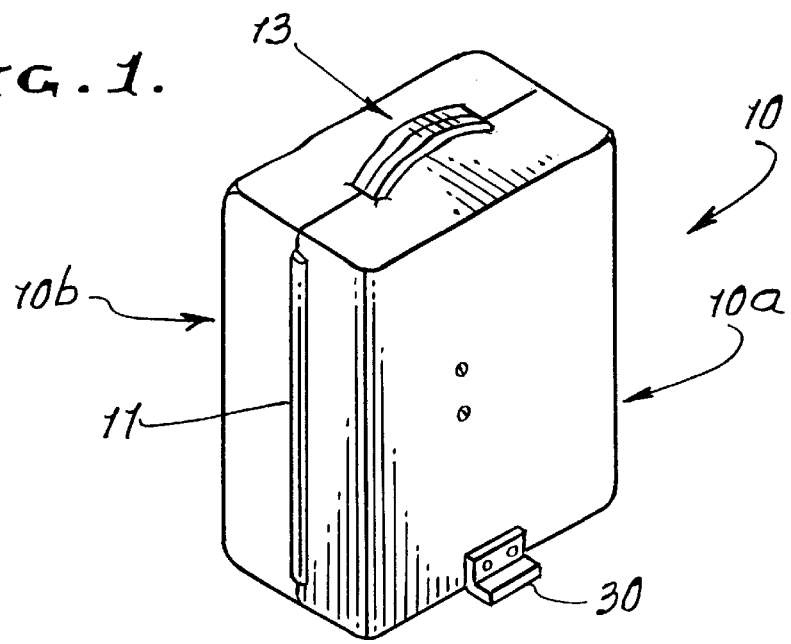
FIG. 1 is a perspective view of a carrying case.
Figure 2:
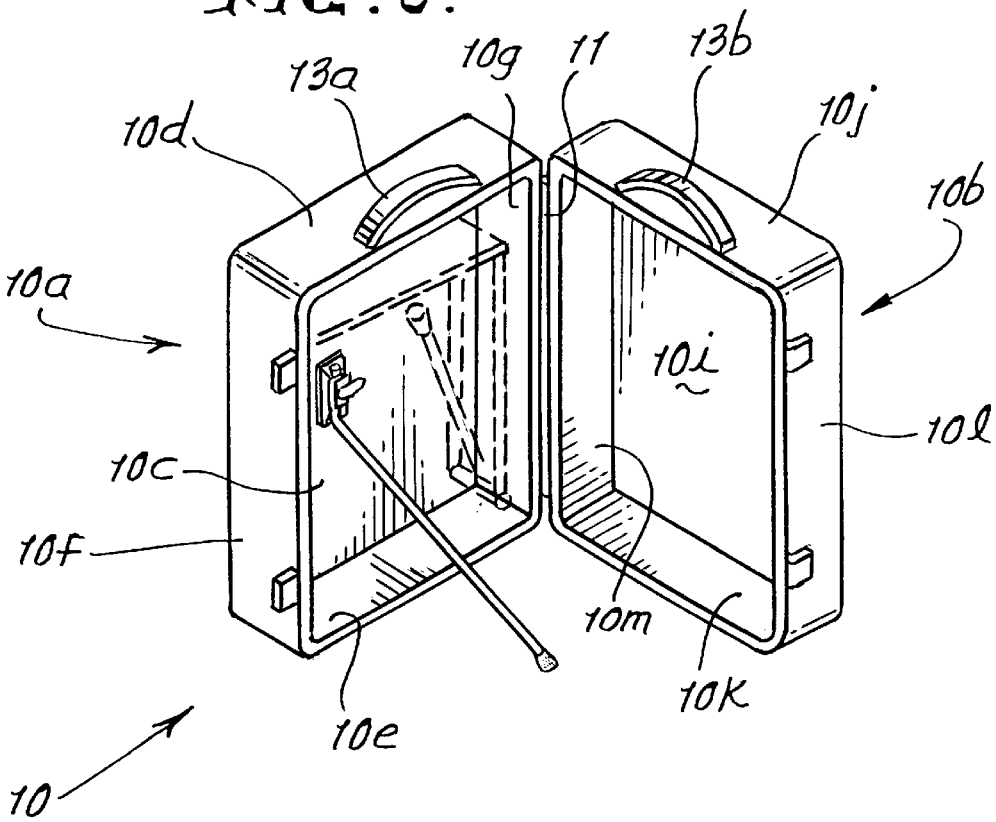
FIG. 2 is a perspective view of the carrying case, opened to allow adjustment of a case support.

In FIGS. 1 and 2, a hollow case 10 is configured, for example, to contain equipment such as musical equipment, for transportation, and for removal from the opened case. In the example, case 10 has two sections, 10*a* and 10*b*, which are hinged together at 11 allowing clam shell opening and closing. In FIG. 2, section 10*b*, opened away from section 10*a*, provides support in addition to that to be described, since section 10*a* extends away from the plane of section 10*a*.

The case has a side wall 10*c* that is relatively stiff, to receive drum beater impact, as seen in FIG. 3. That wall is part of section 10*a* of the case, which also includes top and bottom walls 10*d* and 10*e*, and walls 10*f* and 10*g*. Opened case section 10*b* also has a side wall 10*i*, top and bottom walls 10*j* and 10*k*, and walls 10*l* and 10*m*. The case may have a carry handle, as for example is seen at 13, with two sections 13*a* and 13*b* that close toward one another to extend in adjacent relation, as seen in FIG. 1, for grasping during transportation.

In accordance with an important aspect of the invention, a main support is carried by the case to support it with side wall 10*c* extending upright, and in a selected position relative to a drum beater unit, as during striking of that wall 10*c* by a drum beater as for example beater or mallet 14 of the pedal unit 15 in FIG. 3. As foot pedal 16 is depressed, the beater is driven forwardly to strike wall 10*c*. A drive chain is shown at 17 with one end connected to the pedal, and the other end engaging a sprocket 18, to rotate the sprocket and an axle 19, to which beater 14*a* is connected. See for example, the pedal unit of U.S. Pat. No. 5,627,332.

The side wall 10*c* advantageously consists of relatively stiff plastic material, such as polycarbonate or polystyrene, and the case 10 and wall 10*c* may consist of the same molded plastic material.

As seen in FIGS. 2–5, the illustrated support 20 may comprise a leg having an elongated downwardly and forwardly elongated rod section 20*a*, terminating at a friction foot 20*b* that engages the floor 21 for resisting forward sliding of the case section 10*a* in direction 40. The support is typically adjustable relative to wall 10*c*, and may have an up-turned rod end 20*c* that is gripped to hold it to the inner side 22 of wall 10*c*. End 20*c* extends parallel to the plane of wall 10*c*, and may be rotated in a holder, such as a bearing 23, attached to wall 10*c*, to selected case supporting position. A clamp screw 24 may be tightened to hold rod end 20*c* in leg adjusted position and clamped between bearing sections 23*a* and 23*b*. That screw is carried by the holder 25 attached at 24*a*. Accordingly, very good main support is provided for the opened case in drum beater operating position. In addition, the clamp screw may be loosened, and the support rotated between 23*a* and 23*b*, to bring the leg into stored position in the case, for transportation, along with the pedal unit stored in the case. Tightening of the screw prevents loose rattling of the support in the case, during transport, as by engagement of sections 23*a* and 23*b*, pivoted at 23*c*.

Figure 6:
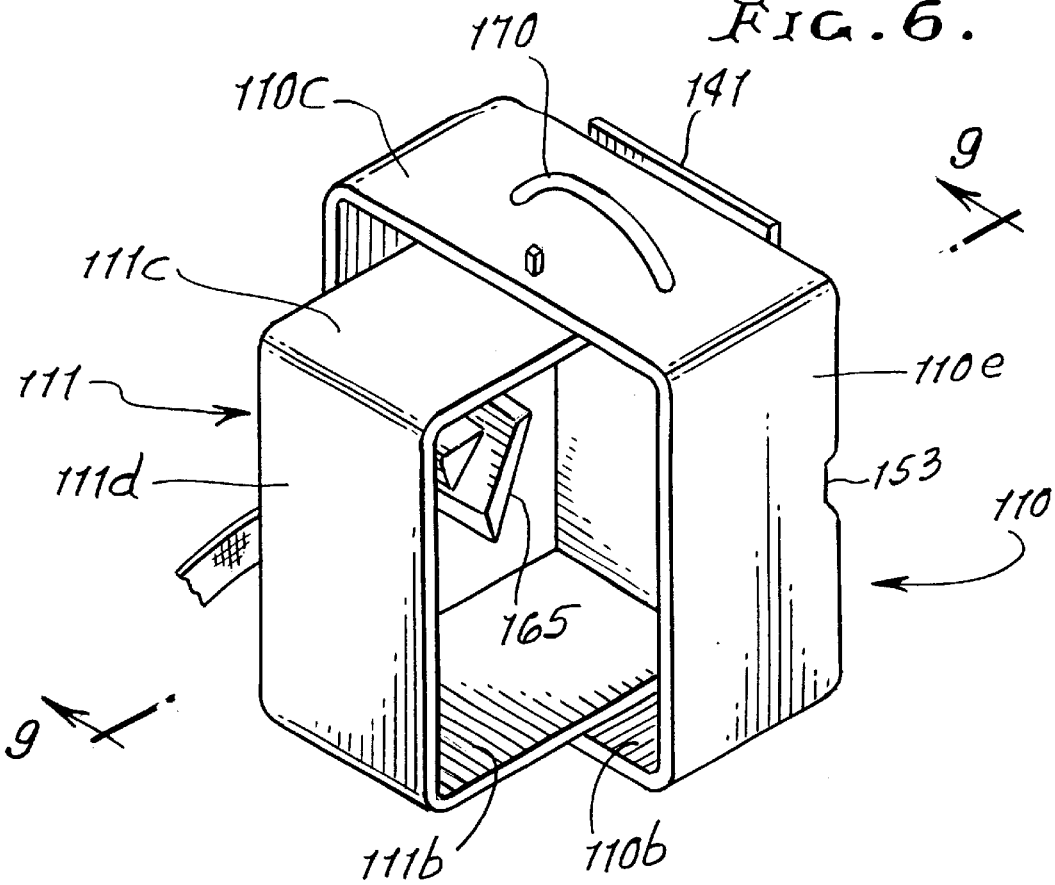
FIG. 6 is a perspective view like FIG. 2, but showing a modification, with a case and cover adjusted to support the case and cover during beater impact.
Figure 9:
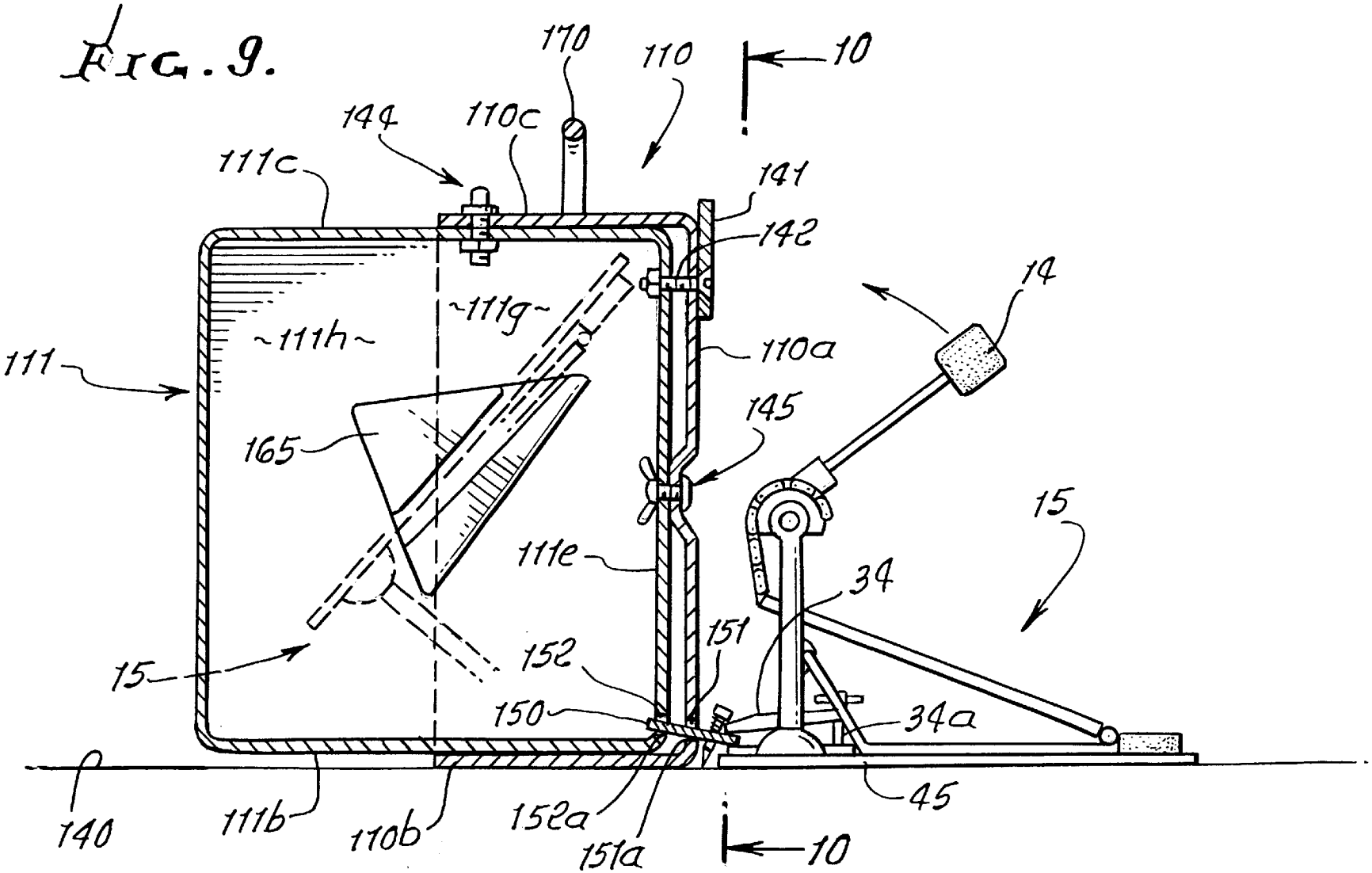
FIG. 9 is a side elevation, taken in section, showing interconnection of the case and cover, and also interconnection to a base of a drum pedal unit.

A ledge may be provided on the case and projecting for engagement by a clamp associated with a drum beater unit extending proximate the case. That ledge may take the form of a foot 30 rigidly attached to, or attachable to, the case, to project rearwardly, near the bottom extent of wall 10*c*, as seen in FIG. 3. The foot projects for engagement by a clamp associated with a drum beater unit extending proximate the case. See for example the clamp plate 34 carried by the pedal unit bottom plate 45, to grip the foot between toes 35 and 36, for holding the pedal unit in selected adjacency to the case wall 10, for optimum drumming. Referring now to FIGS. 6 and 9, the modified and preferred structures include:

a) a hollow case 110 to contain equipment (such as a pedal unit 15 normally used to strike a bass drum) for transportation, and removal from the case;

b) the case 110 having a side wall, as at 110*a* that is relatively stiff;

c) and a support (such as case section 111) to support the case with side wall 110*a* extending or presented in a selected (for example upright) position, during striking motion transmitted to the side wall by the drum beater or mallet 14.

The case 110 and the case section 111 both have receptacle configuration, the receptacle configuration of 111 being slightly smaller than that of the case, so that the side walls 111*b* and 111*c* of 111 will closely fit at the inner sides of walls 110*b* and 111*b* respectively. See FIGS. 6 and 9, for example, with portions 111*g* of 111 extending inside case 110; and portion 111*h* of 111 extending rearwardly of 110.

Projecting portion 111*h* of 111 provides rearward support, proximate the floor region 140 limiting or blocking rearward tilting of the case and case section during beating action of mallet 14 with impact force transmission to the upper extent of wall 110*a*. A striker metallic plate 141 can be attached to wall 110*a* as by fastener or fasteners 142, to prevent wear of wall 110*a*. Both 110 and 111 typically consist of molded plastic material. Case section 111 has a bottom wall 111*b*, as shown, which stiffens the section 111 for support of case 110, as during beating by mallet 14.

The FIG. 9 adjusted position of 111 relative to 110 is secured, as by fastener 144 interconnecting walls 110*c* and 111*c*, and by fastener 145 interconnecting walls 110*a* and 111*e*. In that position of 110 and 111, an anchor plate 150 connects 110 and 111 to the base 45 of the pedal unit. A clamp plate 34 on the pedal unit, when tightened down as by adjustment screw 34*a*, clamps down on the anchor plate 150 to clamp it against edges 151*a* and 152*a* of lower openings 151 and 152 in 110 and 111, holding the latter firmly against the floor. Tongue 150*a* of T-shaped plate 150 projects in the openings 151 and 152.

Figure 7:
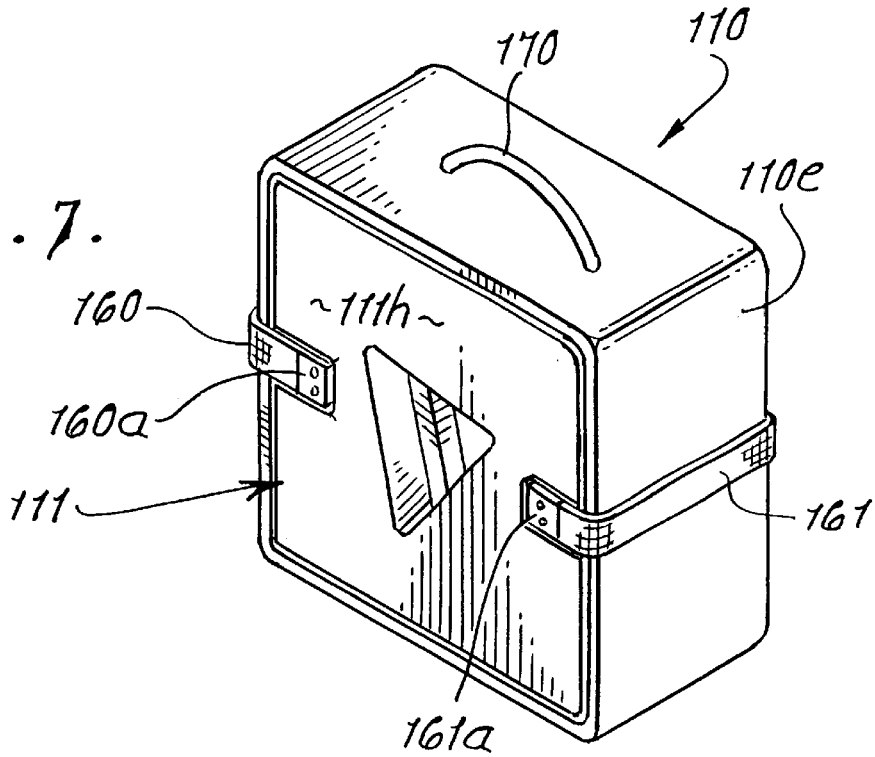
FIG. 7 is a perspective view like FIG. 6, but showing the modified case and cover in telescopically assembled condition, for transport.

Wrap-around straps 160 and 161 hold the case 110 and case section 111 in telescopically interfitting relation, for transport, as seen in FIGS. 7 and 10. The strap anchor ends 160*a* and 161*a* are attached to wall 111*h*, and wrap around walls 110*d* and 110*e*, and wall 110*a*, to a strap interconnection at strap ends 160*b* and 161*b*. A groove 153 in wall 110*a* receives the straps.

Extension 165 on wall 111*h* projects into the interior of 111, to orient or position the pedal unit within that interior, for transport. A transport handle is indicated at 170.

What is claimed is:

1. For use as a substitute drum, the combination comprising a) a hollow case to contain equipment for transportation, and removal from the case, b) the case having a side wall that is relatively stiff, c) and a support to support the case with said side wall extending in a selected position, during striking motion transmitted to the side wall by a drum beater, d) said support extending from the interior of the case, when opened, to the exterior of the case.

2. The combination of claim 1 wherein said side wall consists of plastic material.

3. The combination of claim 1 wherein the case including said side wall consists of molded plastic material.

4. For use as a substitute drum, the combination comprising a) a hollow case to contain equipment for transportation, and removal from the case, b) the case having a side wall that is relatively stiff, c) and a support to support the case with said side wall extending in a selected position, during striking motion transmitted to the side wall by a drum beater, d) wherein said side wall faces the case interior, and said support is configured to support the side wall at the case interior, and extends to the case exterior.

5. The combination of claim 4 wherein said support includes an elongated leg.

6. The combination of claim 5 wherein said leg has an end portion connected to said side wall, at the case interior, and a foot at the case exterior, when the leg is in case supporting position.

7. The combination of claim 6 wherein said leg has an alternate position wherein the leg is stored, at the interior of the case, for transportation.

8. The combination of claim 1 including a ledge on the case and projecting for engagement by a clamp associated with a drum beater unit extending proximate the case.

9. The combination of claim 8 including said drum beater carried by said unit, and facing toward said wall.

10. The combination of claim 6 including a ledge on the case and projecting for engagement by a clamp associated with a drum beater unit extending proximate the case.

11. The combination of claim 1 including a handle on the case, for transporting same, and above the level of the ledge having the form of a projecting foot.

12. The combination of claim 1 wherein the case interior is sized for reception of a drum beater unit defining said drum beater, to enclose said unit when the case is closed.

13. The combination of claim 7 wherein the case interior is sized for reception of a drum beater unit defining said drum beater, to enclose said unit when the case is closed, and wherein said leg alternate position is adjacent the drum beater unit received in the case interior.

14. The combination of claim 1 wherein the case has two sections, hinge connected to allow clam shell opening and closing, and to provide additional support for one of the sections having said side wall, when the case is open.

15. The combination of claim 6 including a bearing attached to said side wall, and supporting said leg end portion for rotation.

16. The combination of claim 15 wherein said leg end portion extends upright in the bearing, the leg extending downwardly at an angle to said end portion, and a clamp screw for engaging the end portion to hold it in adjusted position.

17. The combination of claim 1 wherein said support comprises a case section.

18. The combination of claim 17 wherein said case section has receptacle configuration.

19. The combination of claim 18 including an attachment attaching the case section to the case in a section adjusted position wherein the case section projects both into and out of the case interior.

20. The combination of claim 17 including an anchor plate attached to the case.

21. The combination of claim 20 wherein the anchor plate has T-shape configuration.

22. The combination of claim 17 including a striking plate attached to the case, at a level to be struck by a drum beater carried by a rotor supported on a beater unit base.

23. The combination of claim 21 including a striking plate attached to the case, at a level to be struck by a drum beater carried by a rotor supported on a beater unit base, and wherein the anchor plate is positioned at a lower level to be attached to said beater unit base.

24. The combination of claim 17 including a retention strap extending about the case and case section telescopically assembled for transport.

25. The combination of claim 24 including a groove defined by one of the case and case section to receive the strap.

26. The combination of claim 1 including a stiff upright plate carried by the core and defining a drum beater striking surface.

27. The combination of claim 26 wherein said plate is connected to a base defined by the case.

* * * * *